United States Patent [19]

Offeringa

[11] 4,042,029

[45] Aug. 16, 1977

[54] CARBON-DIOXIDE-ASSISTED PRODUCTION FROM EXTENSIVELY FRACTURED RESERVOIRS

[75] Inventor: Jan Offeringa, Rijswijk, Netherlands

[73] Assignee: Shell Oil Company, Houston, Tex.

[21] Appl. No.: 647,954

[22] Filed: Jan. 9, 1976

Related U.S. Application Data

[63] Continuation-in-part of Ser. No. 571,463, April 25, 1975, abandoned, and Ser. No. 586,106, June 11, 1975, abandoned.

[51] Int. Cl.[2] ..... E21B 43/26

[52] U.S. Cl. ..... 166/272; 166/305 R

[58] Field of Search ..... 166/269, 272, 305 R, 166/306

[56] References Cited

U.S. PATENT DOCUMENTS

| | | | |
|---|---|---|---|
| 2,936,030 | 5/1960 | Allen | 166/306 |
| 3,120,265 | 2/1964 | Allen | 166/306 |
| 3,193,006 | 7/1965 | Lewis | 166/269 |
| 3,405,761 | 10/1968 | Parker | 166/269 |
| 3,653,438 | 4/1972 | Wagner | 166/272 |
| 3,841,406 | 10/1974 | Burnett | 166/305 R |
| 3,845,821 | 11/1974 | Allen et al. | 166/269 |

*Primary Examiner*—Ernest R. Purser

[57] ABSTRACT

In an oil reservoir which is extensively fractured, the amount of oil recovered is increased by forming gaseous and liquid layers within the fracture network, flowing gaseous $CO_2$ into the gaseous layer, and producing liquid which contains oil from the liquid layer. The rates and locations of those injections and productions are correlated to keep the interface between the gaseous and liquid layers at selected depths.

10 Claims, 5 Drawing Figures

CARBON-DIOXIDE-ASSISTED PRODUCTION FROM EXTENSIVELY FRACTURED RESERVOIRS

CROSS REFERENCE TO RELATED PATENT APPLICATION

This application is a continuation-in-part of applications Ser. No. 571,463 filed Apr. 25, 1975, and Ser. No. 586,106 filed June 11, 1975, both of which are now abandoned. The disclosures of those applications are incorporated herein by cross-reference.

BACKGROUND OF THE INVENTION

The invention relates to a process for increasing the amount of oil which can be recovered from an extensively fractured oil reservoir.

An extensively fractured oil reservoir is composed of relatively small, low permeability matrix blocks separated from each other by a network of interconnected fractures (which may be supplemented by solution channels, vugs and other cavities). In such reservoirs, some oil is often found within the fractures but most of the oil is present within the low permeability matrix blocks. Although secondary recovery processes are needed to increase the oil recovery, the conventional process, such as waterflooding, gas injection or the like, are generally inapplicable in a highly fractured reservoir.

For example, a publication by S. J. Pirson, bulletin of the American Association of Petroleum geologist, Vol. 37, February 1953, page 232, discusses production problems of highly fractured reservoirs. It indicates that, in view of the tendency for the gravity segregation of fluids in the fracture network and capillary effects to trap oil within the matrix blocks, it is desirable to reduce the extent of gravity segregation by applying a high horizontal drive pressure gradient and as high a draw down (at the production well) as can be employed without undue water encroachment. Alternatively, it recommends selectively completing the wells for producing only from the lower zone (e.g., by plugging-off the upper zone) and using cyclic depressurizations followed by gradual depressurizations during production cycles.

In a publication by S. H. Raza, First Turkey Petroleum Congress, Ankara, Turkey, Dec. 14–16, 1970 proceedings, pages 27–133, November 1971, such production problems are further discussed. It mentions that, in addition to the unsuitability of waterflooding, gas injection and the like, a water-imbibition procedure is only applicable where the reservoir is strongly water-wet and then may provide only an unattractively low rate of production. If the reservoir is sealed to an extent such that fluids can be confined at relatively high pressures, a cyclic pressure pulsing process can be used.

In a cyclic pressure pulsing process one or two water pressure cycles precede at least one gas pressure cycle or a series of alternating gas and water pulsing cycles. In such processes, nitrogen, methane and carbon dioxide have been indicated to be equally effective where oil viscosity is relatively low, although the volume required for a pressurization with $C0_2$ is significantly greater. However, such pressuring and de-pressuring steps are relatively expensive unless the total oil-free fluid filled pore space of the reservoir is small enough that it can be refilled with relatively high pressurized gas in a relatively short time.

It is known that, when injected into a subterranean reservoir and subjected to sufficient pressure, carbon dioxide becomes relatively miscible with oil. When $C0_2$ dissolves in an oil the oil becomes a solution having a larger volume, a lower viscosity, and a lower interfacial tension against a gas. Numerous patents have proposed using $C0_2$ as a fluid to be injected to cause a miscible fluid drive that displaces oil toward a production location. Such processes, which require a relatively uniformly permeable reservoir, are described in patents such as British Patent No. 669,216 and U.S. Pat. Nos. such as 2,623,596; 2,875,883; 2,936,030; 3,065,790; 3,120,265; 3,405,761; 3,687,198 etc.

U.S. Pat. No. 3,653,438 describes a gravity-aided miscible-drive process that is particularly applicable to a viscous oil reservoir having a high and relatively uniform permeability. An oil-soluble gas such as carbon dioxide and/or a mixture of carbon dioxide and/or a mixture of carbon dioxide and liquid petroleum gas is injected at an upper level within the reservoir while a petroleum product comprising a mixture of oil and gas is produced at a lower level. Where the oil zone overlies an active aquifer, nitrogen or any low valued gas is preferably injected into the highest point within the reservoir to maintain an overall reservoir pressure that prevents or controls the water encroachment.

However, as indicated above, such previously proposed drive or drainage processes that involve the flowing of oil through a reservoir of relatively uniform permeability are not applicable to an extensively fractured reservoir. In such a fractured reservoir the permeability is very high in the fracture network but is very low within the oil-containing rock matrix. Drive fluids flow easily through the fracture network, but bypass the oil in the matrix blocks. In addition, because of the gravity segregation of the fluid within the fractures, any undissolved gas spreads quickly to the vicinity of any production location. Therefore, if a mixture of liquid and undissolved gas is produced while an oil-soluble gas is being injected, the injected gas may be produced before any significant proportion of it has been dissolved in oil.

SUMMARY OF THE INVENTION

The present invention relates to increasing the amount of oil recovered from an extensively fractured reservoir in which liquid hydrocarbons are contained in matrix blocks of low permeability surrounded by a relatively highly permeable network of interconnected fractures. The reservoir is first treated by injecting or producing fluid to the extent necessary to form, within the fracture network, a substantially gas-filled gas layer that overlies a substantially liquid-filled liquid layer. Fluid which contains or comprises gaseous $CO_2$ is then injected so that gaseous $CO_2$ flows into the gas layer in an amount sufficient to provide a $CO_2$ partial pressure of at least about 30% of the total pressure in at least a lower portion of the gas layer. An oil-containing liquid which is substantially free of undissolved gas is produced from the liquid layer. And, the rates and locations of the injections and productions are correlated or adjusted to keep the interface between the gas and liquid layers at selected depths within the fracture network.

DESCRIPTION OF THE INVENTION

Figure 1:
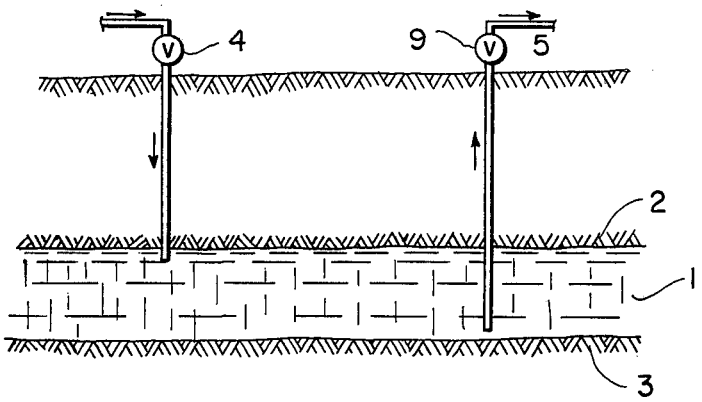
FIG. 1 schematically shows a section of a fractured limestone formation in which no gas cap is present.

The present invention is, at least in part, premised on the following discovery. When a gas layer is present within an extensively fractured reservoir, liquid hydrocarbons can be recovered at a suitable rate by maintaining an atmosphere of $CO_2$ within the fracture network. In this way the tendency for fluids to flow freely and undergo gravity segregation within the network of fractures (which hindered production in prior processes) can be used as an advantage. When a fluid that contains or comprises gaseous $CO_2$ is injected, the $CO_2$ is relatively quickly distributed throughout the horizontal extent of the gas layer. This causes the $CO_2$ gas to contact and dissolve in the oil contained in many of the matrix blocks. The $CO_2$-dissolution swells the oil, while reducing its interfacial tension and viscosity, and displaces the swollen oil into the fractures. Within the fractures the swollen oil is segregated into a location near the interface between the gas and liquid layers. From there a substantially gas-free liquid that contains the oil can readily be produced.

The probable efficiency of such an oil production mechanism has been indicated by laboratory tests. Cores of earth formations of permeabilities of from about 1 to 10 millidarcies were cleaned and dried in the air and then were substantially saturated with a highly refined kerosene fraction predominating in C-11 to C-15 hydrocarbons. Models of low permeability matrix blocks surrounded by highly permeable fractures were formed by placing core samples, which were cylinders about ½ inch in diameter and 2½ inches long, in plastic centrifuge tubes. The core-containing tubes were maintained at 70° F and the air in the tubes was displaced with gaseous $CO_2$ at about 850 psi. At such pressure and temperatures, if the surrounding gas is air or nitrogen, instead of $CO_2$, the capillary forces which hold the oil in the pores are stronger than the force of gravity, and the oil does not drain. But, when the surrounding gas is sufficiently rich in $CO_2$, the interfacial tension between the $CO_2$ and the oil is low enough so that oil drainage occurs at a significant rate. Since the interfacial tension between an oil and air in known to be comparable to that between the oil and a hydrocarbon gas (e.g., a solution-gas released from an oil) such tests indicate that when matrix rock blocks previously exposed to hydrocarbon gas are subsequently surrounded by $CO_2$ gas, a similar relatively rapid drainage will occur in an oil reservoir. Thus, the extent of oil recovery from an extensively fractured reservoir can be increased by such a process. It appears that this can occur even at moderate pressures (e.g., less than 1,000 psi) in reservoirs at moderate temperatures (e.g., less than about 100°F). In addition, a more substantial enhancement of oil recovery will occur at higher pressures (1,000 to 10,000 psi), even at higher reservoir temperatures (100° F to 300° F).

In general, the present invention is applicable to substantially any oil-containing extensively fractured reservoir in which (a) the permeability within the fracture-surrounded blocks of matrix is small enough to trap oil by capillary action, and (b) the permeability within the inter-connected fractures is high enough so that fluids undergo gravity segregation and the pressure gradients are less than the liquid heads over horizontal distances of significant extent. Reservoirs to which the present process is applicable can be either oil-wet or water-wet or a combination thereof. Although such highly fractured reservoirs can be either predominately siliceous or carbonaceous, they are often carbonaceous and are commonly referred to as highly fractured limestone formations. Such reservoirs are encountered in the Middle East oil fields, and in West Texas oil fields such as the Yates Field and the TXL Devonian Field. Although the fractures in an extensively fractured reservoir are usually natural fractures, they can be natural fractures supplemented by artificially induced fractures or can comprise a network of relatively closely spaced interconnected artificially induced fractures such as those resulting from a nuclear detonation, a chemical explosive and/or a massive hydraulic fracturing operation, etc.

Figure 3:
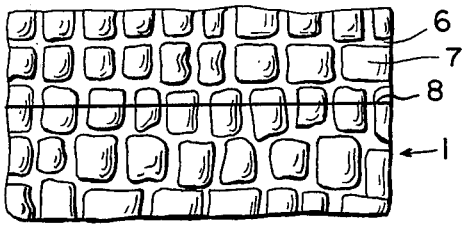
FIG. 3 schematically shows an enlargement of such a fractured limestone formation.

Referring to the drawing, FIG. 1 shows an extensively fractured limestone formation 1 located between caprock 2 and base rock 3 and penetrated by wells 4 and 5. As shown in FIG. 3, formation 1 contains a plurality of relatively impermeable matrix blocks 7 surrounded by a network of interconnected relatively highly permeable fractures 6.

Figure 2:
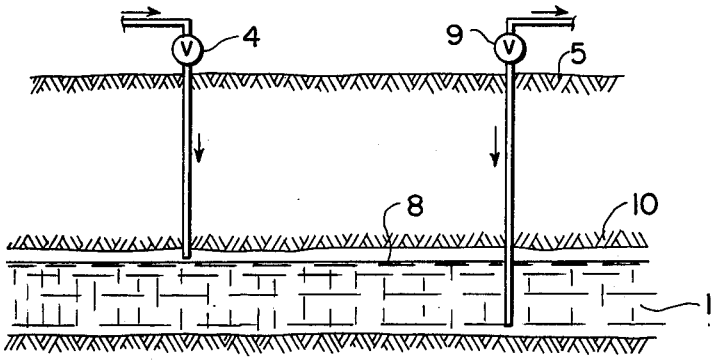
FIG. 2 schematically shows a section of the formation shown in FIG. 1 at a later stage of an oil recovery operation.

The wells and well-completing equipment and techniques can comprise those currently available. As indicated in FIGS. 1 and 2 the injection wells are preferably opened into fluid communication with the reservoir formation within an upper portion of the reservoir while the production wells are opened into a lower portion of the reservoir. This is preferably accomplished by extending each well through the reservoir and cementing-in a casing string which is subsequently perforated at depths at which fluids are to be injected or produced. However, if desired, such wells can be perforated throughout the reservoir interval. In this case, since the wells communicate with the fracture network, within it, regardless of where gases are injected, they are promptly segregated to the top of the reservoir. The bottom of a production tubing string through which liquid is to be produced can be isolated from the upper portion of the well borehole that contains it with a packer or the like. Where such a packer is used it is preferably one which can be relocated to change the depth from which fluid is produced.

FIG. 1 illustrates the starting of the present process in a reservoir in which substantially all of the pore space, in both matrix blocks 7 and fractures 6, is filled with a mixture of aqueous liquids and hydrocarbons (e.g., oil). In such a situation, within the fractures, the oil would tend to be located above the aqueous liquid, but within the pores of the matrix blocks, since the tendency toward gravity segregation is opposed by capillary action, the extent of segregation would be much less. Both oil and water will often be initially distributed nearly equally over most of the height of a matrix rock block located above the water level existing in the fractures.

In the first step of the present process, the reservoir is treated by injecting or producing fluid to the extent necessary to form, within the fracture network, a layer of gas that overlies a layer of liquid. Where the reservoir oil contains a significant proportion of dissolved gas and the reservoir fluid pressure is relatively high, such a gas layer can be formed by producing oil while either maintaining or reducing the reservoir pressure. Where the original reservoir pressure is to be maintained, gas can be injected through well 4 while liquid is produced through well 5, with substantially equal volumes of fluid being injected and produced. Where the reservoir pressure is to be reduced, the liquid is produced, with or without any gas injection, at a volumetric rate faster than that at which gas is injected. As shown in FIG. 2 a gas layer (or gas cap) can be formed, with a gas-liquid interface 8 existing between the gas and liquid layers within the fracture network. The depth of interface 8 is, of course, directly responsive to the relative rates of gas injection and liquid production. The depth location of the interface falls when the volume of liquid produced exceeds the volume of gas injected, etc.

Whether or what kind of gas should be injected in order to form such a gas layer is primarily an economic decision. If a gas is injected such a gas can be air, nitrogen, flue gas or other low-cost gas and/or carbon dioxide. Where desired, such a gas can be heated and/or can comprise a hot vapor such as steam. If the reservoir oil contains a high proportion of dissolved gas for which the current market is good, if desired, the solution gas can be produced while another gas is injected and liquid is produced so that the reservoir pressure is adjusted to or is kept at a selected value while both oil and gas are recovered for marketing during the forming of a gas layer within the fracture network. If the oil is significantly more valuable with its gas in solution, such an oil can be recovered from the produced liquid while gas is being injected, with the relative rates being adjusted to substantially maintain or, if desirable, to increase the pressure within the reservoir during the forming of the gas layer within the fracture network.

Where the reservoir oil viscosity is high enough and/or the oil mobility is low enough to impede the rate of fluid flow and/or gravity segregation of fluids wherein the fracture network, additional steps may be desirable prior to or during the formation of the gas cap within the fracture network. Conventional fluid drive and/or thermal drive procedures can be employed to recover the oil contained in the fractures and/or to reduce its viscosity or increase its mobility. In such a treatment, the drive is preferably conducted throughout the vertical extent of the reservoir. For example, this can be done by opening wells such as 4 and 5 throughout the total vertical interval of formation 1 and injecting a gaseous or liquid drive fluid through one while producing fluid through the other so that most of the drive flows through the fracture network while bypassing the matrix blocks 7. In such a fracture-cleaning step, the circulated fluid can comprise an aqueous liquid of the type used in a waterflood, chemical flood, miscible drive, or the like. Or, the fracture-cleaning fluid can comprise light hydrocarbon fractions (LPG), or contain or form hot fluids that thermally mobilize the oil. During such a fracture-cleaning step, particularly where a pattern of wells is employed, the pressure differentials due to the pressure differences between the fluid injection pressures and production well drawdown pressures are preferably made as high as feasible in order to confine the zone that is swept by the fracture-cleaning fluid to those within the well pattern to be employed.

In the present process, fluid which contains or comprises gaseous $CO_2$ is injected so that gaseous $CO_2$ flows into the gas layer or gas cap. The proportion of $CO_2$ in at least a lower portion of the gas cap should be sufficient to cause a significant amount to dissolve in the reservoir oil. In general, in reservoirs having relatively low temperatures and pressures the total gas pressure should be at least about 500 psi and the proportion of $CO_2$ should be sufficient to provide a partial pressure amounting to at least about 30% of the total gas pressure. The $CO_2$-containing gas can be injected above or below the gas liquid interface and its injection can be continuous or intermittent. Because of the high permeability and tendency for gravity segregation within the fracture network, the $CO_2$, or other gas injected in the present process, can be injected at substantially any rate not requiring an injection pressure that exceeds the fracturing pressure of the overlying formations. In an extensively fractured reservoir, any injected gas moves quickly into the gas cap and the pressure within the gas cap remains substantially the same throughout the total horizontal area occupied by the gas.

In the present process fluid which contains oil and is substantially free of undissolved gas is produced from the liquid layer within the fracture network. Since the density of a reservoir oil is usually less than that of an aqueous liquid, the oil within such a liquid layer tends to be concentrated just below the gas-liquid interface. Thus, the oil-containing substantially gas-free liquid that is produced from the reservoir is preferably produced from near the top of the liquid layer. Such production can be intermittent or continuous. The point of the fluid withdrawal is preferably located such a distance below the gas-liquid interface as to maintain a relatively high oil-cut in the produced fluid as compared to water coning upward and gas coning downward into the oil layer and thus being produced together with crude oil.

In the present process, the rates and locations of the injections and productions of fluid are correlated so that oil-containing liquid is produced and the gas-liquid interface remains at or is moved to selected depth locations within the fracture network. As known to those skilled in the art, in an extensively fractured reservoir, the magnitude of the oil saturation in the matrix blocks of the reservoir may vary with depth. If the reservoir has undergone a pressure decline, for example due to the receding of water and/or a lowering of temperature, or due to a long prior primary production period or the like, the gas cap may have existed for a significant time. In such a situation the extent to which gravity segregation has occurred within the matrix blocks is a function of the native viscosity and/or mobility of the oil, interfacial tension properties of the oil, the distance above or below the gas-liquid interface, etc.

In general, as the gas-liquid interface is lowered in the fracture network, some oil and/or water will drain out of the matrix rock into the fractures. Gas phase either invades the matrix rock to a limited extent, or pervades the rock by coming out of solution in the oil if the reservoir pressure is reduced below the bubble point pressure during this phase of the process. The gas saturation (volume fraction of the pore space) in the matrix rock will then, because of the capillary pressure gradient due to interfacial tension between gas and oil, be highest at the top of the matrix blocks and lowest near the liquid level in the fractures. Thus, the oil saturation is least at the top of the blocks and is greatest at the oil level in the fractures.

Where the reservoir is substantially liquid-filled at the time the process is started, it is generally advantageous to control the rates and locations of fluid injections and productions so as to move the gas liquid-interface from substantially the top to the bottom of the reservoir while maintaining enough $CO_2$ in the gas cap to dilute and swell a significant proportion of the oil present in the matrix blocks. The depths from which the substantially gas-free liquid is produced are preferably adjusted to the extents required to keep them near the top of the liquid layer within the fracture network. The rates of fluid injections and productions are preferably arranged to maintain a relatively high pressure throughout substantially the total production operation, so that gaseous and liquid hydrocarbons and $CO_2$ can be recovered during a final blow-down production phase involving a gradual de-pressuring of the reservoir.

Figure 4:
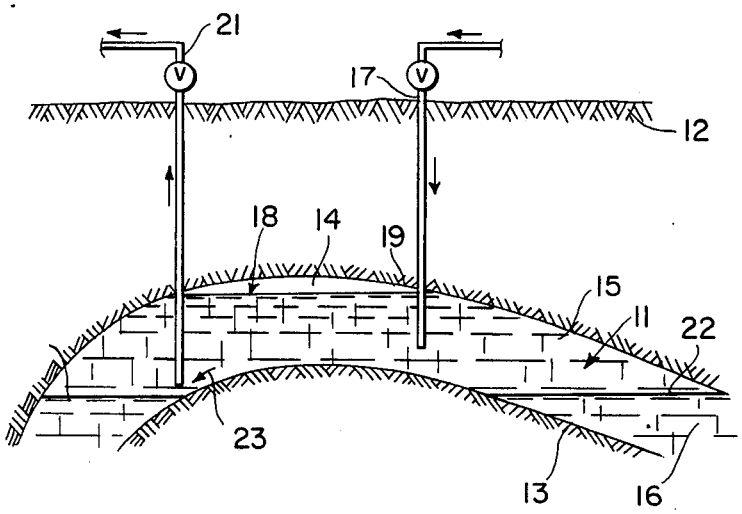
FIG. 4 schematically shows a section of a fractured limestone formation which contains a gas cap.
Figure 5:
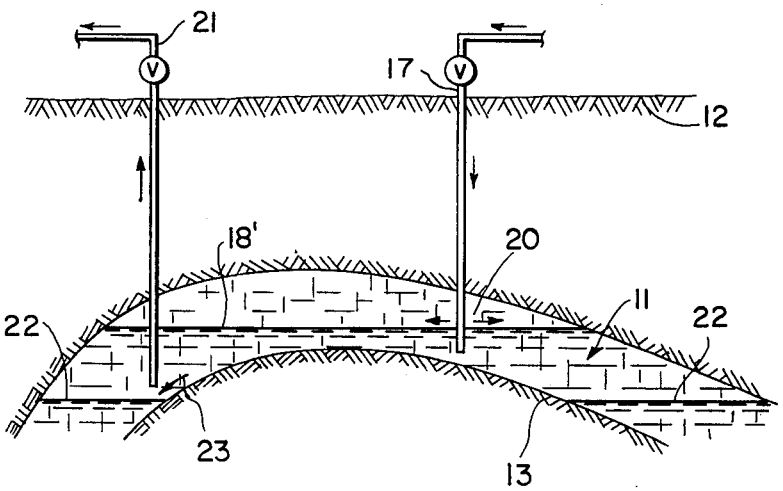
FIG. 5 schematically shows a section of the formation shown in FIG. 4 at a later stage of an oil recovery operation.

In the situations shown in FIGS. 4 and 5 of the drawing, a fractured limestone formation 11 is located between cap rock 12 and base rock 13. The space of formation 11 not filled with limestone is occupied by the gas of gas cap 14, the oil of oil zone 15, and the water of water layer 16. The gas cap 14 is filled with hydrocarbon gas and the pressure of the gas is sufficiently high to transport oil out of the fractures to the surface of the earth.

Well 17 penetrates the formation 11 and communicates with formation 11 at a level just above the gas/oil interface 18. Well 17 is used for the introduction of $CO_2$-containing gas into formation 11. In a preferred embodiment the $CO_2$ is injected just above that interface, as indicated by arrows 19. When that interface has been lowered, e.g., after the production of a certain amount of oil at a volumetric rate exceeding that of the gas injection, the level at which carbon dioxide gas is introduced into the formation 11 is lowered. This new level is shown in FIG. 5. As can be seen from FIG. 5, the carbon dioxide gas is introduced (see arrows 20) at a level just above the new oil/gas level 18. This takes advantage of the tendency for the oil saturation to be relatively high in the zone just above the gas/oil interface and the tendency for the $CO_2$, which is denser than a hydrocarbon gas, to underrun the gas originally present and thus to be the most concentrated where the oil is the most concentrated.

Well 21 also penetrates the formation 11 but communicates with it at a level which is relatively low in the oil zone 15 but is sufficiently far from above water/oil interface 22 to prevent entraining excessive proportions of water from the water zone 16. Well 21 thus produces a substantially gas-free liquid consisting mainly of oil.

In the present process the rates and locations of the injection and production of fluid can be correlated so that the water/oil interface 22 is maintained at its original location by maintaining the pressure within the gas cap 14 constant. This pressure may fall after opening the production well 21, but the introduction of carbon dioxide gas into the gas cap 14 via the well 17 can restore and maintain the pressure. By producing oil (by internal gas drive and/or by gravity drainage and/or under influence of the pressure in the gas cap 14) at a rate such that the gas/oil interface 18 will fall, the oil-filled fractures which were originally just below interface 18 will become filled with gas. Since the carbon dioxide gas supplied to the gas cap 14 (see arrow 19) has a density higher than that of the gas originally present in the gas cap 13, the fractures that fall dry will be filled with carbon dioxide gas. This gas will subsequently be dissolved in the oil trapped in the pore space of the limestone blocks surrounding the gas-filled fractures and lower the interfacial tension thereof to an extent such that part of this oil will be drained from the pore space under influence of the gravity against capillary forces and be collected in the oil zone 15, from where it will be recovered via the well 21. The injection of the carbon dioxide gas may also take place at other levels than the levels 19 and 20. Since the flow resistance through the fractures is extremely low and the density of the carbon dioxide gas is higher than the density of the gas originally present in the gas cap 14, the carbon dioxide gas may also be injected at a relatively high level within gas cap 14, either via the well 17 or via a number of other wells (not shown), since the carbon dioxide gas tends to flow downwards towards the gas/oil interface 18 and to follow this interface on its downward movement during production of oil.

The gas cap 14 in formation 11 may result (wholly or partially) from a previous production of oil. In such a case, the injection well 17 preferably communicates with the gas cap at a high level thereof to allow any carbon dioxide gas that is injected via this well to flow through the majority of fractures in the gas zone to displace hydrocarbon gas therefrom (via a not-shown gas production well). The carbon dioxide gas (which may be mixed with other gas or other gases compatible with carbon dioxide gas with regard to the surface tension lowerng properties thereof) lowers the surface tension of the oil trapped by capillary action in the blocks that are situated in the gas cap. Consequently, oil is drained from these blocks and flows through the fractures to join the oil already present in the fractures.

The carbon dioxide gas used for carrying out the present method can be obtained from any available source. It may either be pure or mixed with other siutable gases. If desired, other agents for lowering the viscosity of oil may be added or incorporated within the injected $CO_2$ containing gas. For example, that gas can be heated. Such a gas may either be obtained from a surface source or from a subsurface source, such as a natural source. The carbon dioxide gas dissolved in the oil that is produced via the production wells can be separated therefrom, for example by using known separation procedures, and subsequently be reinjected into the fractured limestone formation. Also, at least some of the carbon dioxide gas which is injected can be formed by injecting an an oxygen-containing gas into the reservoir formation under conditions that allow combustion of oxygen with liquid — and/or gaseous hydrocarbons (primarily within the fractures) to generate carbon dioxide gas in situ. Or, by conducting an underground combustion at sufficiently high combustion temperatures, limestone rocks in a reservoir formation can be decomposed, thereby generating additional quantities of carbon dioxide gas.

Where the carbon dioxide gas used in the present process is mixed with other gases, such gases should be selected to avoid reducing the effectiveness of the carbon dioxide to lower the interfacial tension of oil. Hydrocarbons which are gaseous at the reservoir conditions, e.g., methane and ethane are compatible with carbon dioxide and are suitable for this purpose. The presence of nitrogen should, however, be minimized. In general, the influence of other gases on carbon dioxide in this respect can readily be determined in order to decide which gases that are available for injection purposes should be used. Also, the most favorable ratio of the quantities of gases injected can be easily ascertained by known tests. With most substantially nitrogen-free mixtures of gases inclusive of $CO_2$, a mixture that contains enough $CO_2$ to provide a partial pressure $CO_2$ gas of at least about 30% of the total gas pressure will yield favorable results.

Where desirable the $CO_2$-containing gas that is flowed into the gas cap may be, at least in part, derived from an injection of an aqueous liquid which is saturated with and/or mixed with $CO_2$ into a lower portion of the reservoir, preferably near the top of the aqueous liquid level in a reservoir that contains an oil layer sandwiched between a gas cap and a water layer. Similarly, hot aqueous and/or gaseous fluids can be injected and circulated within either or both of the gas or liquid layers within the reservoir. In such procedures the average total rates and locations of $CO_2$-containing fluid injections and substantially liquid-fluid productions are correlated so that the interface between the gas and liquid layers is kept at selected depths within the fracture network.

What is claimed is:

1. In a process for producing oil from an extensively fractured reservoir in which oil is contained in matrix blocks of relatively low permeability which are surrounded by a network of interconnected fractures of relatively high permeability, the improvement comprising:

treating the reservoir by injecting or producing fluid to the extent necessary to form within the fracture network a substantially gas-filled gas layer which (a) overlies a substantially oil-filled liquid layer, and (b) surrounds a multiplicity of relatively low permeability oil-containing matrix blocks;

injecting fluid which contains or comprises $CO_2$ in a manner such that gaseous $CO_2$ flows into the gas layer within the fracture network in an amount sufficient to provide a $CO_2$ partial pressure of at least about 30% of the total pressure in at least a lower portion of the gas layer;

producing an oil-containing liquid that is substantially free of undissolved gas from within the liquid layer; and correlating the rates and locations of the injections and productions of fluid so that the interface between the gas and liquid layers is kept at selected depths within the network of fractures while the swollen oil is being displaced into and produced from the network of fractures.

2. The process of claim 1 in which the reservoir is initially substantially completely liquid filled and the interface between the gas and the liquid layers is moved from substantially the top to the bottom of the reservoir.

3. The process of claim 1 in which the initial viscosity of the reservoir oil is relatively high and, prior to said formation of a substantially gas-filled layer, oil-displacing fluid is circulated through the fractured network to increase the permeability of that network.

4. The process of claim 1 in which the total average rates of fluid injections and productions are correlated to maintain the pressure of the reservoir at a selected relatively high value.

5. A process for producing oil which comprises:

establishing fluid communication with a subterranean reservoir formation in which oil is contained within fracture-surrounded blocks having a matrix permeability low enough to trap oil by capillary action and the fractures surrounding the blocks form a network of interconnected fractures having a permeability high enough that fluids within the fractures undergo gravity segregation;

treating said reservoir formation by injecting or producing fluid to the extent necessary to form a gas layer overlying a liquid layer within the fracture network;

injecting fluid that contains or comprises carbon dioxide so that enough carbon dioxide flows into the gas layer to provide a carbon dioxide partial pressure of at least about 30% of the total pressure in at least a lower portion of the gas layer;

producing oil-containing liquid which is substantially free of undissolved gas from below the top of the liquid layer within the network of fractures; and adjusting the rates and locations of the injections and productions of fluid so that the interface between the gas and the liquid layers in the network of fractures is kept at selected depths.

6. The process of claim 5 in which carbon dioxide is injected during the formation of the gas layer within the fracture network.

7. The process of claim 5 in which liquid is produced faster than fluid is injected during the formation of the gas layer in the fracture network so that at least a portion of the gas in that layer is solution gas released from the reservoir oil.

8. The process of claim 5 in which the reservoir oil viscosity is relatively high and, prior to the forming of the gas layer within the fracture network, an oil-displacing fluid is circulated through at least a portion of the fracture network to cause an increase in permeability by a romoval of relatively viscous fluid.

9. The process of claim 5 in which the injected fluid which contains or comprises carbon dioxide consists essentially of carbon dioxide or comprises carbon dioxide gas mixed with a lesser volume of hydrocarbon gas.

10. The process of claim 9 in which the injected fluid which contains or comprises carbon dioxide is injected at a pressure of at least about 1,000 psi and the rates of the injections and productions of fluid are adjusted to maintain a pressure of at least 1,000 psi within the fracture network throughout the production of a significant proportion of oil.

* * * * *